US007905965B2

(12) United States Patent
Gigliotti et al.

(10) Patent No.: US 7,905,965 B2
(45) Date of Patent: Mar. 15, 2011

(54) METHOD FOR MAKING SOFT MAGNETIC MATERIAL HAVING FINE GRAIN STRUCTURE

(75) Inventors: Michael Francis Xavier Gigliotti, Scotia, NY (US); Richard DiDomizio, Scotia, NY (US); Luana Emiliana Iorio, Clifton Park, NY (US); Francis Johnson, Clifton Park, NY (US); Pazhayannur Ramanathan Subramanian, Niskayuna, NY (US); Mahesh Chandran, Bangalore (IN)

(73) Assignee: General Electric Company, Niskayuna, NY (US)

( * ) Notice: Subject to any disclaimer, the term of this patent is extended or adjusted under 35 U.S.C. 154(b) by 688 days.

(21) Appl. No.: 11/563,700

(22) Filed: Nov. 28, 2006

(65) Prior Publication Data

US 2008/0121315 A1 May 29, 2008

(51) Int. Cl.
*C21D 8/12* (2006.01)
*C22C 38/10* (2006.01)

(52) U.S. Cl. ..... 148/311; 148/112

(58) Field of Classification Search ..... 148/122, 148/120, 360–311

See application file for complete search history.

(56) References Cited

U.S. PATENT DOCUMENTS 5,080,731 A * 1/1992 Tabaru et al. ..... 148/103
5,501,747 A * 3/1996 Masteller et al. ..... 148/311
5,741,374 A 4/1998 Li
6,255,005 B1 * 7/2001 Yokoyama et al. ..... 428/683
2002/0062885 A1 5/2002 Li
2003/0170138 A1 * 9/2003 Ishida et al. ..... 420/70
2004/0089377 A1 5/2004 Deevi et al.
2004/0226404 A1 * 11/2004 Ozaki et al. ..... 75/252
2005/0247373 A1 * 11/2005 Hammer et al. ..... 148/111
2007/0289676 A1 * 12/2007 Deevi et al. ..... 148/311

FOREIGN PATENT DOCUMENTS

JP 2000312446 A * 11/2000
JP 2000351040 A * 12/2000

OTHER PUBLICATIONS

Derwent 2003-904249 abstract for the patent family including US 20040247373 A1 published Nov. 10, 2005.*
English translation of DE 102 21 793 C1, published Apr. 12, 2003.*
The ASM Handbook Online, copyright 2002, http://products.asminternational.org/hbk/do/highlight/content/V02/D02/A01/S0021936.html accessed Oct. 17, 2008.*
Machine translation of JP 2000312446, published Nov. 2000.*
Machine translation of JP 2000351040, published Dec. 2000.*

* cited by examiner

*Primary Examiner* — George Wyszomierski
*Assistant Examiner* — Tima M McGuthry-Banks
(74) *Attorney, Agent, or Firm* — Paul J. DiConza

(57) ABSTRACT

A method of making a soft magnetic material with fine grain structure is provided. The method includes the steps of providing a soft magnetic starting material; heating the soft magnetic starting material to a temperature at which the material has a microstructure comprising at least two solid phases; and deforming the soft magnetic starting material. An electrical device comprising a magnetic component is provided. The magnetic component comprises a soft magnetic material having a grain size less than about 3 micrometers. The material has a composition that comprises at least two solid phases at temperatures greater than about 500° C.

36 Claims, 4 Drawing Sheets

METHOD FOR MAKING SOFT MAGNETIC MATERIAL HAVING FINE GRAIN STRUCTURE

BACKGROUND OF THE INVENTION

The invention is related to a method of making a soft magnetic material. More particularly, the invention is related to a method of making a soft magnetic material having fine grain structure.

Magnetic materials play a key role in a number of applications, especially in many electric and electromagnetic devices. There is a continually growing need for higher performance electric machines in various applications such as power generation. Compact machine designs may be realized through an increase in the rotational speed of the machine. In order to operate at very high speeds, these machines need rotors with higher yield strength materials along with lower magnetic core losses, as well as the ability to operate at maximum flux densities. Generally, achieving high strength, high ductility, and superior magnetic performance concurrently is difficult in conventional materials, because high strength typically is obtained at the expense of ductility and magnetic properties such as magnetic saturation and core loss. Therefore, there is a need for a magnetic material with superior magnetic properties and higher mechanical strength when compared with currently available materials. There is a further need for an efficient method for producing these materials.

BRIEF DESCRIPTION OF THE INVENTION

The present invention meets these and other needs by providing a soft magnetic material with fine grain structure and having high yield strength, good ductility, and improved magnetic properties.

One embodiment of the invention described herein is a method. The method comprises providing a soft magnetic starting material; heating the soft magnetic starting material to a temperature at which the material has a microstructure comprising at least two solid state phases; and deforming the soft magnetic starting material.

Another embodiment of the invention is to provide an electrical device comprising a magnetic component. The magnetic component comprises a soft magnetic material having a grain size less than about 3 micrometers. The material has a composition that comprises at least two solid phases at temperatures greater than about 500° C.

DESCRIPTION OF THE DRAWINGS

These and other features, aspects, and advantages of the present invention will become better understood when the following detailed description is read with reference to the accompanying drawing in which like characters represent like parts throughout the drawing, wherein.

DETAILED DESCRIPTION OF THE INVENTION

Figure 1:
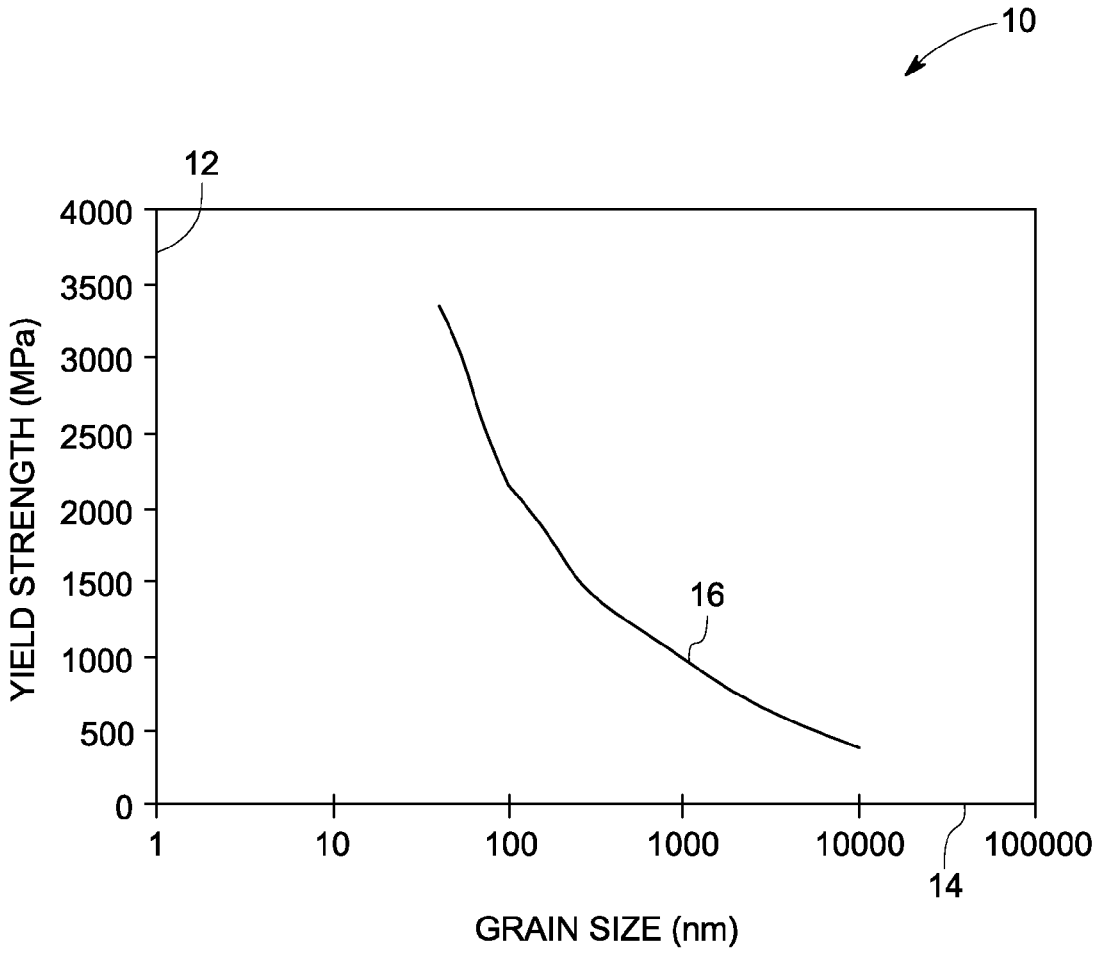
FIG. 1 is a plot of yield strength verses grain size of a magnetic material.

In the following description, like reference characters designate like or corresponding parts throughout the several views shown in the figures. It is also understood that terms such as "top," "bottom," "outward," "inward," "first," "second," and the like are words of convenience and are not to be construed as limiting terms. Furthermore, whenever a particular aspect of the invention is said to comprise or consist of at least one of a number of elements of a group and combinations thereof, it is understood that the aspect may comprise or consist of any of the elements of the group, either individually or in combination with any of the other elements of that group.

For many electrical and electromagnetic devices, soft magnetic materials with high permeability, high saturation magnetization, low core loss, high mechanical strength, and high ductility are preferred. An increase in yield strength with decreasing grain size (Hall-Petch effect) may be utilized to make high strength magnetic materials. Plot 10 in FIG. 1 shows change in yield strength (plotted along left Y axis-12) with change in grain size (plotted along X axis-14). Curve 16 indicates that yield strength increases with decrease in grain size. However, in magnetic materials, the decrease in grain size is often detrimental to the magnetic properties, specifically core loss and coercivity. While it is known that typically coercivity increases with decreasing grain size in material with micron-sized grains, Herzer (G. Herzer, "Grain size dependence of coercivity and permeability in nanocrystalline ferromagnets," IEEE Trans. Magn., vol. 26, pp. 1397-1402, 1990.), illustrated that below a critical grain size, the relationship between coercivity, $H_c$, and grain size, D, changes such that $H_c$ is proportional to $D^{1/6}$.

Achieving magnetic materials with fine grain size, good yield strength and ductility as well as low coercivity has proven to be a very challenging task. Many methods such as rapid solidification, controlled thermal processing after conventional deformation processing, and compaction of nanocrystalline powders have been attempted to prepare fine grained magnetic materials. These methods have not been successful in producing a bulk material with minimum dimensions, such as thickness of more than about 100 micrometers, having high strength and ductility as well as high saturation magnetization and low core losses. Despite such efforts, there is no simple method to produce, on an industrial scale, bulk magnetic materials having engineered fine grain sizes and having minimum dimension greater than about 100 micrometers. Especially, there is a need for methods to fabricate materials having a structure that falls within the preferred grain size window to provide the material with the right balance of yield strength, ductility, magnetic saturation and coercivity in a single material.

Disclosed herein is a versatile method for making magnetic materials with controlled fine grain structure, substantially high yield strength, and superior magnetic properties. In accordance with aspects of the present invention, it has been determined that it is possible to fabricate soft magnetic alloys with a fine grain structure by deforming the alloy material under conditions where the material has a microstructure comprising at least two solid phases. In order to process the alloy in a multi-phase condition, the alloy composition should be such that the temperature range over which the multiple phases co-exist (referred to herein as a "multi-phase region, or, in specific exemplary cases, a "two-phase region") is sufficiently large to allow for an industrial deformation process to be implemented. Additionally, the alloy desirably has a single phase at room temperature. Additionally, the high-temperature phase or phases that are used to aid the industrial deformation process shall not be stable at room temperature and thus preferably not present in the alloy at room temperature. Further, the alloy has useful magnetic properties such as suitable saturation magnetization, permeability, and coercivity. The inventors have discovered that certain alloying additions, when added in an appropriate amount, to a soft magnetic alloy such as an iron-cobalt based alloy will expand the two-phase (for example, gamma-alpha) region to enable thermomechanical processing of the alloy in a two-phase region. Further, it has been discovered that processing the alloy in a two-phase region enables grain refinement of the alloy, resulting in a fine-grained alloy with superior magnetic and mechanical properties. The details of the alloying additions and processes are described in the subsequent embodiments.

For the purposes of understanding the invention, a fine grain structure is understood to be a grain structure in which the median grain size is less than about 3 micrometers. In one embodiment, the median grain size is less than about 1 micrometer. As used herein, "a microstructure comprising at least two solid phases" or alternatively "an alloy in a multi-phase or two-phase region" implies that the alloy comprises at least two solid phases in equilibrium. For example, Fe—Co based alloy may comprise both austenite (fcc) and ferrite phases (bcc) for a particular composition-temperature range.

Figure 2:
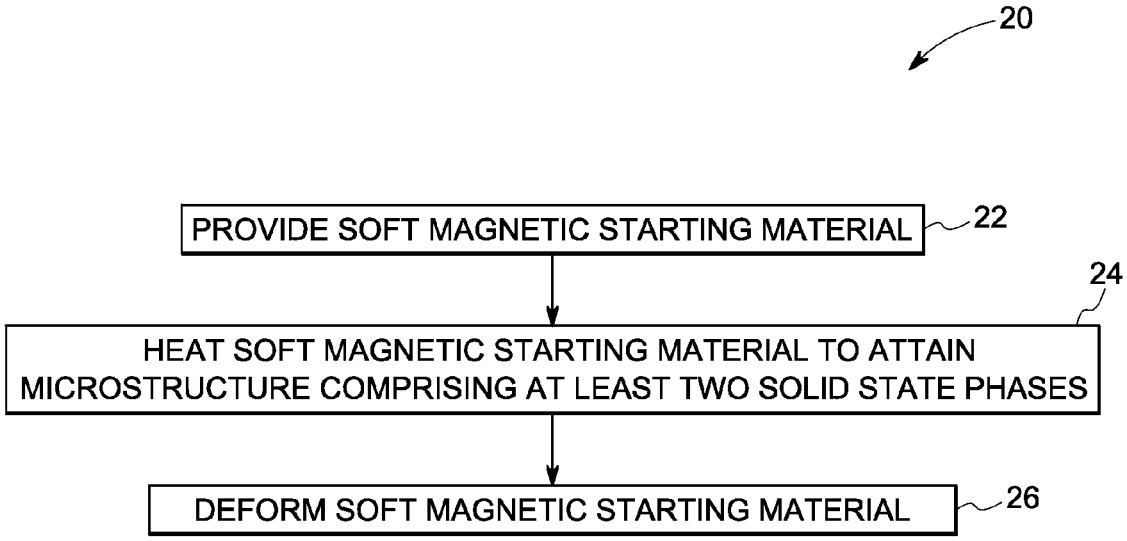
FIG. 2 is a flow chart of the method according to one embodiment of the invention.

A processing route is disclosed for creating a fine grain structure for soft magnetic alloys. The method involves the steps of providing a soft magnetic starting material; heating the soft magnetic starting material to a temperature at which the material has a microstructure comprising at least two solid phases; and deforming the soft magnetic starting material. FIG. 2 shows a flow chart of a method 20 provided for manufacturing an article. The method 20 comprises the steps of providing a soft magnetic starting material in step 22; heating the soft magnetic starting material to a temperature at which the material has a microstructure comprising at least two solid phases, in step 24; and deforming the soft magnetic starting material at the temperature specified from step 24, in step 26. For each alloy composition, the temperature range over which multiple phases coexist may be identified from phase diagrams, thermodynamic calculations, or from actual experiments, and an appropriate heat treatment temperature may be chosen.

In certain embodiments, the soft magnetic starting material comprises iron and cobalt. In one embodiment, cobalt is present in the alloy in the range from about 15 atomic percent to about 60 atomic percent. In another embodiment, the soft magnetic starting material comprises cobalt in the range from about 45 atomic percent to about 55 atomic percent. In one embodiment, the soft magnetic starting material comprises cobalt in the range of from about 20 atomic percent to about 35 atomic percent. The amount of cobalt may be chosen to optimize the magnetic properties of the alloy, reduce the material cost, and enhance the material processability.

Figure 3:
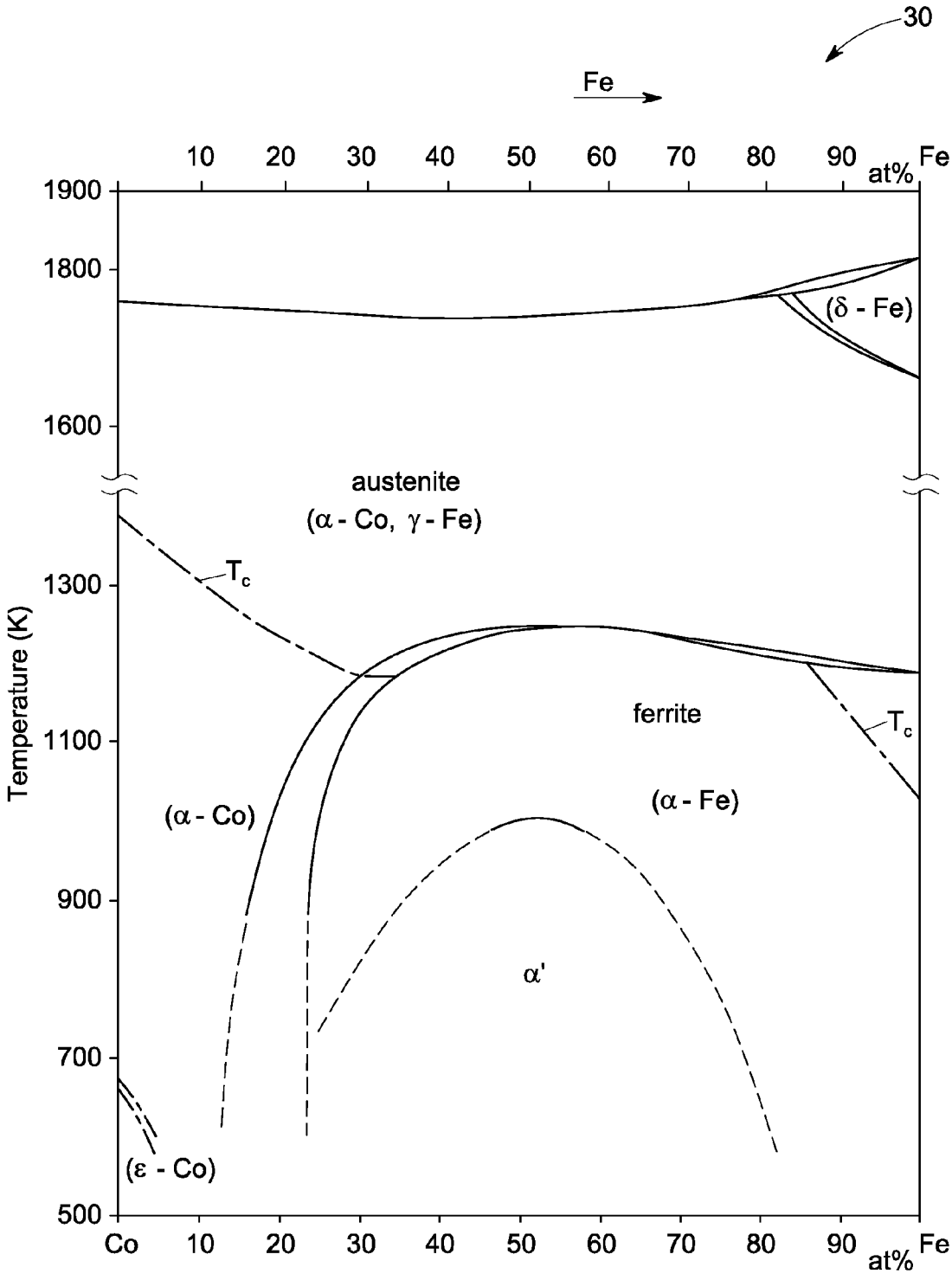
FIG. 3 is a binary phase diagram for Fe—Co.

In embodiments where the soft magnetic starting material comprises Fe—Co alloy, the binary phase diagram of Fe—Co may be used to identify appropriate processing conditions. FIG. 3 shows plot 30, the binary phase diagram for Fe—Co. It is clear that, near equiatomic compositions, Fe—Co based alloys are face-centered cubic (fcc) ($\gamma$) above about 983° C., and body-centered cubic (bcc) ($\alpha$) below this temperature. It is generally accepted that $\alpha$ orders to a B2 structure ($\alpha'$) below 730° C. The addition of alloying elements may produce a temperature interval ($\Delta T$) in which, at equilibrium, both the $\gamma$ and $\alpha$ phases are present in the alloy. For example, an Fe-30Co-3Mn (weight %) alloy is expected to have a $\Delta T$ of about 145° C. In another example, an Fe-30Co-3Mn-0.25C (weight %) alloy is expected to have a $\Delta T$ of about 155° C. In another example, an Fe-30Co-1.75Mn-0.5C-0.1C (weight %) alloy is expected to have a $\Delta T$ of about 133° C.

Accordingly, various alloying additions are introduced into the soft magnetic starting material to expand the multi-phase region, that is, to increase the $\Delta T$ of the alloy beyond what it would be without the alloying additions. In one embodiment, the soft magnetic starting material comprises an (meaning at least one) addition selected from the group consisting of manganese (Mn), carbon (C), tungsten (W), nickel (Ni), platinum (Pt), palladium (Pd), iridium (Ir), ruthenium (Ru), rhodium (Rh), osmium (Os), rhenium (Re), and various combinations of these materials. These additions, when present in an appropriate amount, expand the two-phase ($\gamma$-$\alpha$) region to enable thermomechanical processing of the alloy in a two-phase region. In addition, the soft magnetic starting material may comprise an alloying addition selected from the group consisting of vanadium, silicon, titanium, boron, niobium, chromium, molybdenum, aluminum, tantalum, and combinations thereof. These additions may improve the corrosion resistance, enhance the resistivity, enhance the strength, enhance the ductility or workability of the alloy, or adjust the magnetic properties. Specific combinations of additions are chosen based on the particular requirements of the specific application.

The magnetic and the mechanical properties of the soft magnetic starting material, and the temperature range over which the multi-phase region exist may be controlled by controlling the alloying addition, and the amount of alloying addition introduced. The soft magnetic starting material comprises at least one alloying addition included above. Introduction of these additions is expected to expand the multi-phase region of the alloy. However, the amount of the alloying addition may need to be controlled so as to limit the precipitation of intermetallic compounds, which may adversely affect the magnetic properties of the alloy. Accordingly, in one embodiment, the soft magnetic starting material comprises the alloying addition in an amount less than about 6 atomic percent. In one embodiment, the soft magnetic starting material includes alloying additions in the range from about 0.05 atomic percent to about 2 atomic percent. In another embodiment, the soft magnetic starting material comprises alloying additions in an amount in the range from about 0.05 atomic percent to about 1 atomic percent.

Additional elements may be present in controlled amounts to benefit other desirable properties provided by this alloy. The amount of these additions is selected so as not to hinder the magnetic performance of the alloy. In addition, the alloy may also comprise usual impurities found in commercial grades of alloys intended for similar service or use. The levels of such impurities are controlled so as not to adversely affect the desired properties.

In an exemplary embodiment, the soft magnetic starting material comprises iron, cobalt, and manganese. In another exemplary embodiment, the soft magnetic starting material comprises iron, cobalt, manganese, and carbon. In one embodiment, the cobalt is present in an amount in the range from about 30 atomic percent to about 55 atomic percent, manganese is present in an amount less than about 6 atomic percent, and carbon is present in an amount less than about 2 atomic percent. In another exemplary embodiment, the soft magnetic starting material comprises iron, cobalt, and tungsten. In one embodiment, cobalt is present in an amount in the range from about 30 atomic percent to about 55 atomic percent, tungsten is present in an amount less than about 6 atomic percent. In some embodiments, cobalt is present in an amount up to about 49 atomic percent, and tungsten is present in an amount of up to about 2 atomic percent. The tungsten addition may increase the resistivity of the soft magnetic starting material.

Typically the additions and the composition are chosen such that the microstructure comprises at least two solid phases over a temperature range of at least about 50° C. In another embodiment, the microstructure comprises at least two solid phases over a temperature range of at least about 100° C. When the soft magnetic starting material comprises an iron cobalt alloy, the two solid phases are typically the austenite and the ferrite phase. Austenite is the face centered cubic (fcc) phase and ferrite is the body centered cubic (bcc) phase.

Any deformation process known in the art may be used for processing the soft magnetic starting material in step 26. The deformation process may be any of the known conventional deformation processes, or a severe plastic deformation process. Some suitable conventional deformation processes include, but are not limited to, direct line extrusion, open hot die forging, closed hot die forging, cold rolling, and hot rolling. Some suitable severe plastic deformation processes include, but are not limited to, twist extrusion, equal channel angular extrusion, multi-axis forging, hydrostatic extrusion, accumulative roll bonding, and repetitive corrugation and straightening.

In a particular embodiment, the deformation comprises a severe plastic deformation process. Severe plastic deformation of soft magnetic materials comprising at least two solid phases has proved to be extremely useful for fabricating soft magnetic alloys with fine grain microstructures. The fine grain microstructure may enable, among other improvements, increased tensile strength, and superplastic formability at lower temperatures and higher strain rates than those for coarse grain microstructure.

Some of the severe plastic deformation processes involve hot extrusion of the alloy billet through a die. When the process used is equal channel angular extrusion, the die angle is 90°. When the process used is twist extrusion, the die twist angle is in a range of from about 30° to about 60°. The process may include a single pass or multiple passes through the die, and may or may not include part rotation by a specific angle between each pass. During each pass, the feedstock is subjected to extreme shear deformation, resulting in the generation of an extremely fine deformation substructure and/or significant grain refinement. Subsequent thermo-mechanical processing such as extrusion, rolling or forging; heat treatments, and aging treatments are then applied to the material, as necessary, to further refine the substructure and/or grains in the material and place the material in a condition for use in high strength structural components over a range of temperatures in electric machine applications. By controlling the extent of the extreme deformation and or/subsequent thermal treatment, nanoscale to sub-micron scale refined structures can be produced in the alloys. The final product is a dense structural component with superior mechanical and magnetic properties.

Typically, hot-forging involves the compression of a billet or bar between flat platens that may be heated to some intermediate temperatures. The forging may be conducted in a single step or in a number of stages, wherein the billet is typically reheated between the stages. Multi-axis forging is a variation of the forging process wherein the billet is open-die forged in a number of passes. Between each pass, the billet is reoriented to a different axis and each subsequent pass is conducted with a change of axis of the applied load. The above process provides the advantage of the retention of material cross-sectional area as contrasted with more conventional thermo-mechanical processing such as rolling.

In some embodiments, the soft magnetic starting material is provided in the form of a billet. The process starts with a bulk alloy feedstock in the form of a cylindrical, square, or rectangular billet. This billet can be fabricated using one or more conventional processes such as casting or powder metallurgy gas-atomization and powder consolidation processes, followed if necessary by thermo-mechanical processes, such as extrusion, rolling or forging. This soft magnetic starting material is then used as the feedstock for a deformation step in step 26. Various deformation processes including those listed above may be used to deform the soft magnetic starting material. In an exemplary embodiment, the deforming comprises multi-axis forging. Typically, forging may be done at a temperature of at least about 500° C. In a particular embodiment, forging may be at a temperature in a range from about 750° C. to about 850° C. Factors that are considered in choosing the actual processing temperature include the alloy composition, which determines the temperature range over which multiple phases are present as described above, along with more conventional factors such as, for instance, the desired flow stress of the material during processing.

In an exemplary embodiment, the deformation comprises equal channel angular extrusion (ECAE). ECAE permits the application of a large amount of uniform strain without a reduction in work-piece cross-section and results in large-size processed billets. ECAE may be advantageous because of the formation of uniform microstructures, control over the development of grain morphology, formation of specific texture and ease of process.

In another exemplary embodiment, the deformation comprises hydrostatic extrusion. High pressure may refine grains effectively and produce fine grains. High pressure may be helpful in reducing porosity, cracks and other macroscopic defects that are detrimental to mechanical properties.

In another embodiment, the deformation process comprises repetitive corrugation and straightening. Repetitive corrugation and straightening involves bending and straightening of a sheet sample repetitively to build up significant plastic strain. The method may be capable of yielding bulk sheet materials with fine grains that are free from contamination and porosity.

In some embodiments, the soft magnetic starting material may be deformed within a dynamic recrystallization processing zone, generally defined by particular ranges of temperature, strain, and strain rate. Dynamic recrystallization is a process wherein during deformation under controlled conditions, small dislocation-free regions or sub-grains are formed by dislocation rearrangement within grains and which eventually form recrystallized grains with high-angle grain boundaries. The process may be configured to utilize dynamic recrystallization to achieve grain refinement during open-die forging under controlled temperature and deformation-rate conditions. In contrast to conventional thermo-mechanical processes, which may require subsequent heat treatment to allow highly deformed microstructures to recrystallize into new grains, during processing under dynamic recrystallization conditions, the recrystallized grains are formed during the deformation process. This may facilitate a good control over the microstructure, including texture and grain size of the deformed material, by controlling the temperature, strain, and strain rate. One skilled in the art can identify appropriate values for these various processing parameters to achieve dynamic recrystallization for a given alloy composition by routine experimentation.

Typically during all of the above deformation processes, the strain achieved is at least about 1. In one embodiment, deformation produces a strain in the range from about 1 to about 6. In some other embodiments, the deformation produces a strain in the range of about 2 to about 4. In one embodiment, deformation is carried out at a strain rate in the range from about 0.01/second to about 0.001/second. In one embodiment, deformation is carried out at a strain rate in the range from about 0.001/second to about 0.0001/second. In another embodiment, deforming includes deforming at a strain rate in the range from about 0.005/second to about 0.0005/second. In one embodiment, deformation is carried out at a temperature in a range from about 600° C. to about 1000° C. In another embodiment, the deformation is carried out at a temperature in a range from about 600° C. to about 800° C. In all the above embodiments, the deformation process may be followed by an optional annealing process if needed.

Typically, the processed soft magnetic material has a grain size less than about 3 micrometers. In certain embodiments, the material comprises grain sizes less than about 1 micrometer. The alloy embodiments of the invention desirably exhibit high saturation magnetization, low coercivity, and high mechanical strength. In one embodiment, the soft magnetic material has a saturation magnetization of at least about 1.8 Tesla. In another embodiment, magnetic material has a saturation magnetization at least about 2 Tesla. In one embodiment, magnetic material has a coercivity of less than about 100 Oersteds. In another embodiment, soft magnetic material has a coercivity of less than about 50 Oersteds. The high saturation magnetization values may allow the soft magnetic material to be operated at very high flux densities, enabling compact electric machine designs. In one embodiment, soft magnetic material of the disclosed embodiments has a yield strength of greater than about 500 MPa. In another embodiment, magnetic material has a yield strength of greater than about 700 MPa.

The soft magnetic alloy of the disclosed embodiments is suitable for many magnetic components in various electrical devices. They are especially attractive for magnetic components comprising these alloys in a monolithic body, though the alloys may also be suitable for use in laminated or multi-layered articles as well. As used herein, a "monolithic body" means a three-dimensional body portion constituting a single unit without joint. This is in contrast to a body formed of multiple components, such as a laminated, or a multi-layered structure. Thickness of the monolithic body as used herein refers to the smallest of the dimensions. Accordingly, in some embodiments, the magnetic component comprises the soft magnetic alloy having composition, microstructure, mechanical and magnetic properties as discussed in the method embodiments above. The alloy may be in the form of a sheet, a plate, or a bar. In some embodiments, the bulk monolithic structure has a thickness of at least about 100 micrometers. In another embodiment, the bulk monolithic structure has a thickness of at least about 500 micrometers.

Another embodiment of the invention includes an electrical device. The electrical device comprises a magnetic component, the magnetic component comprising a soft magnetic material, described above, having a grain size less than about 3 micrometers. The material has a composition that comprises at least two solid phases at temperatures greater than about 500° C.

Figure 4:
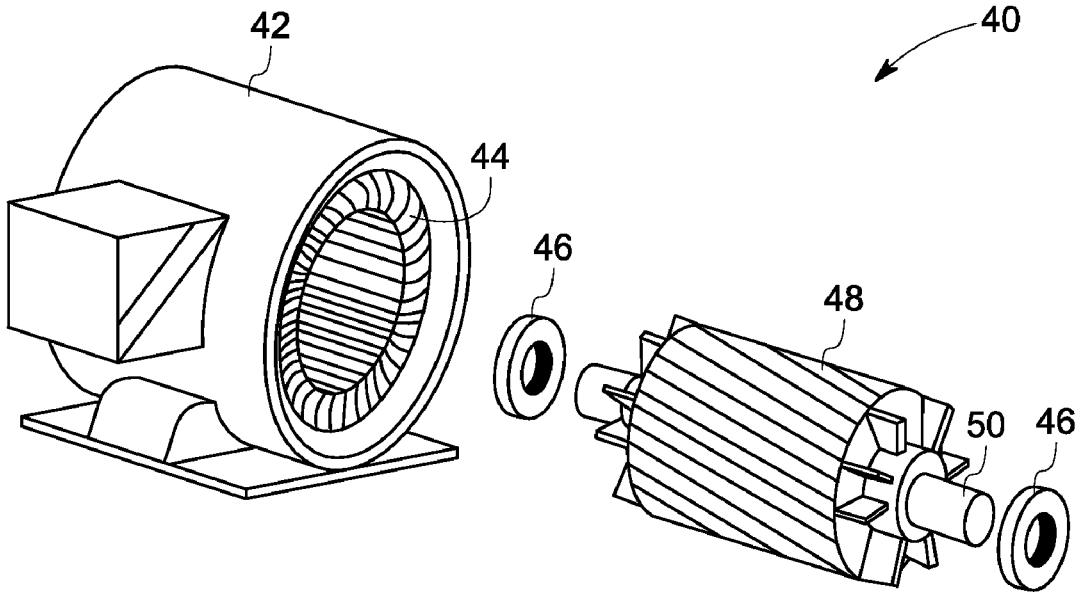
FIG. 4 is a schematic illustration of an electromagnetic device.

FIG. 4 is a diagrammatical perspective illustration of an electrical machine, 40. FIG. 4 is provided for illustrative purposes only, and the present invention is not limited to any specific electrical machine or configuration thereof. In the illustrated example, the machine 40 includes a rotor assembly 42, which includes a rotor shaft 44 extending through a rotor core. The rotor assembly 42 along with the shaft 44 can rotate inside the stator assembly 46 in a clockwise or a counter-clockwise direction. Bearing assemblies 48 that surround the rotor shaft 44 may facilitate such rotation within the stator assembly 46. The stator assembly 46 includes a plurality of stator windings that extend circumferentially around and axially along the rotor shaft 44 through the stator assembly 46. During operation, rotation of the rotor assembly 42 causes a changing magnetic field to occur within the machine 40. This changing magnetic field induces voltage in the stator windings 49. Thus, the kinetic energy of the rotor assembly 42 is converted into electrical energy in the form of electric current and voltage in the stator windings 49. Alternately, the machine 40 may be used as a motor, wherein the induced current in the rotor assembly 42 reacts with a rotating magnetic field to cause the rotor assembly 42 to rotate. In some embodiments, the motor is a synchronous motor and in other embodiments the motor is an asynchronous motor. Synchronous motors rotate at exactly the source frequency scaled up by the pole pair count, while asynchronous motors exhibit a slower frequency characterized by the presence of slip. One skilled in the art would know to implement changes in the design as per the requirement of the device.

One or more of the rotor assembly 42, or the stator assembly 46, of the machine 40 may include soft magnetic alloys of the disclosed embodiments. Superior magnetic and mechanical properties of the soft magnetic alloys of the disclosed embodiments provide distinct advantages in terms of the performance of the machine. The specific composition of the alloy and its magnetic and mechanical property characterization are described in greater detail in the embodiments above. In the examples described herein, the machine 40 is a radial type machine where the flux flows radially through the air gap between the rotor and the stator. However, other examples of the machine 40 may operate with axial flux flow as well, where the flux flows parallel to the axis of the machine 40. Though the operation of the machine 40 is explained with a simple diagram, examples of the machine 40 are not limited to this particular simple design. Other more complicated designs are also applicable and may benefit from the soft magnetic materials discussed in detail above.

The composition of the material, the deformation process, and the grain structure of the alloy material are similar to those explained in the method embodiments above. In certain embodiments, the material comprises a forged material. In other embodiments, the material comprises an extruded material. For example, the soft magnetic alloy may include iron, cobalt, along with various other alloying additions as described in the above embodiments. The composition of the soft magnetic alloy may be chosen based on the desired properties for the specific application of the device, and are similar to those described in above embodiments. Examples of the device include a generator, a motor, an alternator, or a combination thereof. In an exemplary embodiment, the magnetic component comprises a rotor of an electrical machine. In another embodiment, the magnetic component comprises a stator of an electrical machine. Non-limiting examples of the electrical machine include a generator, a motor, and an alternator. In other embodiments, the magnetic component comprises a magnetic bearing, an electromagnet pole piece, an actuator, an armature, a solenoid, an ignition core, or a transformer. As known to those skilled in the art of electrical machines, stator and rotor designs vary based on application, and may include one or more magnetic components. Certain embodiments of the disclosed soft magnetic materials provide performance and/or efficiency improvements for aerospace applications, due to the higher yield strength, lower magnetic core losses, and the ability to operate at relatively higher flux densities than previous magnetic alloys. In other embodiments, the soft magnetic material is incorporated into components of a machine in an electric or a hybrid vehicle, in a bearing assembly, or a wind power system.

It should be understood that the present invention should not be construed as to be limited to a stator or a rotor. Instead the invention should be construed to include other magnetic parts having their own respective three-dimensional shapes. It includes all magnetic motor and generator parts, armatures, rotors, solenoids, linear actuators, gears, ignition cores, transformers, ignition coils, converters, inverters and the like.

The method of the present invention is designed to meet fundamentally different design requirements from those applied to conventional methods used for making magnetic materials with fine grain structure. Typically used methods to make fine grained magnetic materials such as controlled thermal processing after conventional deformation processing or compaction of nanocrystalline powders have not increased strength radically and have been deleterious to the core loss properties. Conventionally used processes to make nanocrystalline magnetic materials such as rapid solidification suffer from a number of drawbacks. Generally rapidly solidified soft magnetic materials have low coercivity and high strength but are limited to thicknesses of less than 20 microns. In addition, rapidly solidified nanocrystalline materials are brittle. The method of the present invention provides magnetic materials with superior magnetic and mechanical properties. It provides magnetic materials that are substantially free of porosity, are homogeneous, and which are ductile.

The following example serves to illustrate the features and advantages offered by the embodiments of the present invention, and are not intended to limit the invention thereto.

Example 1

Fe—Co Composition with Rhenium Alloying Addition

An as-cast right circular cylindrical billet of the alloy Fe-30Co-1.8Re (atomic %) was machined having an aspect ratio of 1.5 to 1. The two-phase field of interest in this alloy extends from 755° C. to 928° C. according to thermodynamic simulations performed using the software Thermo-Calc™. The forging sequence used to refine the grains in this material is summarized in Table 1 and described below. The billet was placed in an open die, isothermal forging press with the flat billet faces against the platens of the press. The flat faces contacting the forging platens are referred to as the "A" faces. The sample and press were ramped to a temperature of 975° C. at a rate of 8° C./min and held at that temperature until the entire billet had reached the desired temperature. The billet was then upset at a strain rate of 0.01/second to a strain of 0.5. The temperature, strain rate, and strain values were chosen to break up and refine the as-cast structure. Upon conclusion of the upset, the billet was removed from the press and allowed to cool to room temperature. With the "B" faces, which are nominally perpendicular to the "A" faces, contacting the forging press platens, the temperature was once again ramped at a rate of 8° C./min to 975° C. and held for 10 minutes. The sample was upset at a strain rate of 0.01/second to a strain of 0.5. Upon conclusion of this upset, the billet was removed from the press and allowed to cool to room temperature. The remaining orthogonal sets of faces that are not upset at this stage are referred to as "C" faces. The billet was placed onto the forging platens such that the "C" faces contacted the platens. Once again the sample was heated to a temperature of 975° C. and upset at a strain rate of 0.01/second to a strain of 0.5, and then removed from the furnace to air cool. This sequence of three upsets, one each with the "A" faces, "B" faces, and "C" faces in contact with the platens, is referred to as a forging operation. Thus, the first forging operation, as described above, was performed with a strain rate of 0.01/second at a temperature of 975° C. Table 1 shows that the second forging operation occurred at the same strain rate but a reduced temperature of 950° C. The temperature, strain rate, and strain values for these two first forging operations were chosen to break up and refine the as-cast structure. The conditions for forging operations three through five were chosen to allow dynamic recrystallization to occur. This was done by reducing the strain rate from 0.01/second to 0.001/second for all remaining upsets and by decreasing the temperature with each subsequent forging operation. Thus, forging operation three was conducted at a temperature of 900° C., forging operation four was conducted at a temperature of 850° C., and forging operation five was conducted at a temperature of 800° C. These process steps resulted in a sample with a saturation magnetization of 2.29 Tesla and a coercivity of 13.6 Oersted.

TABLE 1

Forging Parameters for Fe—Co composition with rhenium alloying addition.

| Upset No. | Contact Face | Strain Rate (1/s) | Strain | Forging Temp. (° C.) | |
|---|---|---|---|---|---|
| 1 | A | 0.01 | 0.5 | 975 | Forging |
| 2 | B | 0.01 | 0.5 | 975 | Operation No. 1 |
| 3 | C | 0.01 | 0.5 | 975 | |
| 4 | A | 0.01 | 0.5 | 950 | Forging |
| 5 | B | 0.01 | 0.5 | 950 | Operation No. 2 |
| 6 | C | 0.01 | 0.5 | 950 | |
| 7 | A | 0.001 | 0.5 | 900 | Forging |
| 8 | B | 0.001 | 0.5 | 900 | Operation No. 3 |
| 9 | C | 0.001 | 0.5 | 900 | |
| 10 | A | 0.001 | 0.5 | 850 | Forging |
| 11 | B | 0.001 | 0.5 | 850 | Operation No. 4 |
| 12 | C | 0.001 | 0.5 | 850 | |
| 13 | A | 0.001 | 0.5 | 800 | Forging |
| 14 | B | 0.001 | 0.5 | 800 | Operation No. 5 |
| 15 | C | 0.001 | 0.5 | 800 | |

Example 2

Fe—Co Composition with Various Alloying Additions

Right circular cylindrical billets of four sample alloys were produced by casting and machining, the compositions of which are listed in Table 2. Sample 1, Fe-30Co-3Mn-0.25C (weight %) has a two-phase field region which extends from 736° C. to 892° C. according to thermodynamic simulations performed using the software Thermo-Calc™. The forging sequence of this alloy is shown in Table 3.

The billet was placed in an open die, isothermal forging press with the flat billet faces against the platens of the press. The flat faces contacting the forging platens are referred to as the "A " faces. The sample and press were ramped to a temperature of 900° C. at a rate of 8° C./min and held at that temperature until the billet reached the desired temperature. The billet was then upset at a strain rate of 0.001/second to a strain of 0.5. Upon conclusion of the first upset, the billet was removed from the press and allowed to cool to room temperature. With the "B" faces, which are nominally perpendicular to the "A" faces, contacting the forging press platens, the temperature was once again ramped at a rate of 8° C./min to 900° C. The sample was upset at a strain rate of 0.001/second to a strain of 0.5. Upon conclusion of this upset, the billet was removed from the press and allowed to cool to room temperature. The remaining orthogonal sets of faces that have not been upset at this stage are referred to as the "C" faces. The billet was placed onto the forging platens such that the "C" faces contacted the platens. Once again the sample was heated to a temperature of 900° C., allowed to equilibrate, and upset at a strain rate of 0.001/second to a strain of 0.5, and then removed from the furnace to air cool. This sequence of three upsets, one each with the "A" faces, "B" faces, and "C" faces in contact with the platens, is referred to as a forging operation. Thus, the first forging operation, as described above, was performed with a strain rate of 0.001/second at a temperature of 900° C. The final two forging operations maintained the same strain rate; however, the temperature was reduced with each subsequent forging operation by 50° C. Forging operation two occurred at a temperature of 850° C. and forging operation three occurred a temperature of 800° C.

TABLE 2

Magnetic properties measured for various Fe—Co compositions.

| Sample | Composition (atomic %) | | | | | Saturation Magnetization | | Coercivity | Density | |
|---|---|---|---|---|---|---|---|---|---|---|
| Number | Fe | Co | Mn | Cr | C | emu/g | Tesla | Oersted | g/cm$^3$ | ΔT ° C. |
| 1 | 67 | 30 | 3 | | | 231 | 2.21 | 5.05 | 7.62 | 145 |
| 2 | 66.8 | 30 | 3 | | 0.25 | 228 | 2.24 | 14.2 | 7.81 | 155 |
| 3 | 66.6 | 30 | 1.75 | 0.5 | 0.1 | 226 | 2.14 | 10.2 | 7.55 | 132 |
| 4 | 67.7 | 30 | 1.75 | 0.5 | 0.05 | 233 | 2.25 | 4.6 | 7.68 | n/c |

TABLE 3

Forging Parameters for Sample 1.

| Upset No. | Contact Face | Strain Rate (1/s) | Strain | Forging Temp. (° C.) | |
|---|---|---|---|---|---|
| 1 | A | 0.001 | 0.5 | 900 | Forging |
| 2 | B | 0.001 | 0.5 | 900 | Operation No. 1 |
| 3 | C | 0.001 | 0.5 | 900 | |
| 4 | A | 0.001 | 0.5 | 850 | Forging |
| 5 | B | 0.001 | 0.5 | 850 | Operation No. 2 |
| 6 | C | 0.001 | 0.5 | 850 | |
| 7 | A | 0.001 | 0.5 | 800 | Forging |
| 8 | B | 0.001 | 0.5 | 800 | Operation No. 3 |
| 9 | C | 0.001 | 0.5 | 800 | |

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method for manufacturing an article, the method comprising:

providing a soft magnetic starting material comprising iron and cobalt, wherein the cobalt is present in an amount in the range from about 15 atomic percent to about 60 atomic percent;

heating the soft magnetic starting material to a temperature above at which the material has a microstructure comprising an austenite phase and a ferrite phase; and deforming the soft magnetic starting material at said temperature.

2. The method of claim 1, wherein the soft magnetic starting material comprises at least one alloying addition selected from the group consisting of manganese, carbon, tungsten, nickel, platinum, palladium, iridium, ruthenium, rhodium, osmium, rhenium, and combinations thereof.

3. The method of claim 1, wherein the soft magnetic starting material further comprises an addition selected from the group consisting of vanadium, silicon, titanium, boron, niobium, chromium, molybdenum, aluminum, tantalum, and combinations thereof.

4. The method of claim 2, wherein the addition is present in a total amount of up to about 6 atomic percent.

5. The method of claim 1, wherein the soft magnetic starting material comprises cobalt in the range from about 20 atomic percent to about 35 atomic percent.

6. The method of claim 1, wherein the soft magnetic starting material comprises cobalt in the range from about 45 atomic percent to about 55 atomic percent.

7. The method of claim 1, wherein the soft magnetic starting material comprises iron, cobalt, and manganese.

8. The method of claim 1, wherein the soft magnetic starting material comprises iron, cobalt, manganese, and carbon.

9. The method of claim 8, wherein cobalt is present in an amount in the range from about 30 atomic percent to about 55 atomic percent, manganese is present in an amount less than about 6 atomic percent, and carbon is present in an amount less than about 2 atomic percent.

10. The method of claim 1, wherein the soft magnetic starting material comprises iron, cobalt, and tungsten.

11. The method of claim 10, wherein the soft magnetic starting material comprises cobalt in an amount in the range from about 30 atomic percent to about 55 atomic percent, tungsten in an amount less than about 6 atomic percent.

12. The method of claim 1, wherein deforming comprises at least one of direct line extrusion, open hot die forging, closed hot die forging, cold rolling, and hot rolling.

13. The method of claim 1, wherein deforming comprises at least one of twist extrusion, equal channel angular extrusion, multi-axis forging, hydrostatic extrusion, high-pressure torsion, accumulative roll bonding, and repetitive corrugation and straightening.

14. The method of claim 1, wherein the deformation induces a strain of at least about 100%.

15. The method of claim 1, wherein the method further comprises annealing at a temperature from about 700° C. to about 1000° C.

16. The method of claim 15, wherein annealing produces a material with a grain size less than about 3 microns.

17. The method of claim 1, wherein deforming comprises multi-axis forging.

18. The method of claim 17, wherein multi-axis forging comprises forging at a temperature of at least about 500° C.

19. The method of claim 17, wherein multi-axis forging comprises forging at a temperature in a range from about 750° C. to about 850° C.

20. The method of claim 1, wherein the microstructure comprises the at least two solid phases over a temperature range of at least about 50° C.

21. The method of claim 1, wherein the microstructure comprises the at least two solid phases over a temperature range of at least about 100° C.

22. A method comprising:

providing a soft magnetic starting material comprising iron, cobalt, and manganese, wherein the cobalt is present in an amount in the range from about 15 atomic percent to about 60 atomic percent;

heating the soft magnetic starting material to a temperature at which the material has a microstructure comprising an austenite phase and a ferrite phase; and multi-axis forging the soft magnetic starting material at said temperature.

23. An electrical device comprising:

a magnetic component, the magnetic component comprising a soft magnetic material comprising iron and cobalt, wherein the cobalt is present in an amount in the range from about 15 atomic percent to about 60 atomic percent, the material having a grain size less than about 3 micrometers, wherein the material has a composition that comprises an austenite phase and a ferrite phase at temperatures greater than about 500° C.

24. The electrical device of claim 23, wherein the soft magnetic starting material comprises at least one alloying addition selected from the group consisting of manganese, carbon, tungsten, nickel, platinum, palladium, iridium, ruthenium, rhodium, osmium, rhenium, and combinations thereof.

25. The electrical device of claim 23, wherein the soft magnetic starting material further comprises an addition selected from the group consisting of vanadium, silicon, titanium, boron, niobium, chromium, molybdenum, aluminum, tantalum, and combinations thereof.

26. The electrical device of claim 24, wherein the addition is present in a total amount of up to about 6 atomic percent.

27. The electrical device of claim 23, wherein the at least two solid phases comprises an austenite and a ferrite phase.

28. The electrical device of claim 23, wherein the soft magnetic starting material comprises iron, cobalt, manganese, and carbon.

29. The electrical device of claim 28, wherein cobalt is present in an amount in the range from about 30 atomic percent to about 55 atomic percent, manganese is present in an amount less than about 6 atomic percent, carbon is present in an amount less than about 2 atomic percent.

30. The electrical device of claim 23, wherein the magnetic material has a median grain size of less than about 1 micron.

31. The electrical device of claim 23, wherein the magnetic component comprises a monolithic structure.

32. The electrical device of claim 31, wherein the monolithic structure has a thickness of at least about 100 micrometers.

33. The electrical device of claim 23, wherein the material comprises a forged or an extruded material.

34. The electrical device of claim 23, wherein the electrical device comprises one selected from the group consisting of a generator, a motor, and an alternator.

35. The electrical device of claim 23, wherein the component comprises an electric generator rotor.

36. The electrical device of claim 23, wherein the magnetic component comprises one selected from the group consisting of a magnetic bearing, an electromagnet pole piece, an actuator, an armature, a solenoid, an ignition core, and a transformer.

* * * * *